US011667366B2

(12) United States Patent
Sun et al.

(10) Patent No.: US 11,667,366 B2
(45) Date of Patent: Jun. 6, 2023

(54) STEERING DEVICE, STEERING DEVICE FOR SHIP AND SWITCHING VALVE

(71) Applicant: HITACHI ASTEMO, LTD., Hitachinaka (JP)

(72) Inventors: Xing Sun, Hitachinaka (JP); Hayato Tsutsui, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 93 days.

(21) Appl. No.: 17/203,089

(22) Filed: Mar. 16, 2021

(65) Prior Publication Data

US 2022/0234709 A1 Jul. 28, 2022

(30) Foreign Application Priority Data

Jan. 22, 2021 (JP) ..... JP2021-009147

(51) Int. Cl.

| | |
|---|---|
| ***B63H 20/12*** | (2006.01) |
| ***F15B 15/14*** | (2006.01) |
| ***F15B 13/02*** | (2006.01) |
| ***F15B 11/024*** | (2006.01) |

(52) U.S. Cl.

CPC ..... *B63H 20/12* (2013.01); *F15B 11/024* (2013.01); *F15B 13/021* (2013.01); *F15B 15/149* (2013.01); *F15B 2211/20561* (2013.01)

(58) Field of Classification Search

CPC .. F15B 2211/40507; F15B 2211/40515; F15B 2211/40; F15B 2211/30; F15B 15/149; B63H 20/12

See application file for complete search history.

(56) References Cited

U.S. PATENT DOCUMENTS 5,505,641 A 4/1996 Onoue

FOREIGN PATENT DOCUMENTS

GB 2239488 A * 7/1991 ..... B63H 25/22
JP 06-127475 A 5/1994

* cited by examiner

*Primary Examiner* — Abi Y Teka
*Assistant Examiner* — Daniel S Collins
(74) *Attorney, Agent, or Firm* — Leason Ellis LLP; Edward J. Ellis; Melvin C. Garner

(57) ABSTRACT

A steering device includes: a cylinder demarcated into first and second chambers by a piston; a main valve having first and second shuttle chambers; a hydraulic source having first and second discharge ports; a first oil passage configured to connect the first chamber and the first shuttle chamber; a second oil passage configured to connect the second chamber and the second shuttle chamber; a third oil passage configured to connect the first shuttle chamber and the first discharge port; a fourth oil passage configured to connect the second shuttle chamber and the second discharge port; and a tank connected to the main valve via the third oil passage and the fourth oil passage. One of the first shuttle chamber and the second shuttle chamber of the main valve is in an opened state when the hydraulic source is stopped.

15 Claims, 3 Drawing Sheets

STEERING DEVICE, STEERING DEVICE FOR SHIP AND SWITCHING VALVE

CROSS-REFERENCE TO RELATED APPLICATION

This application is based upon and claims the benefit of priority to Japanese Patent Application No. 2021-009147, filed on Jan. 22, 2021, the entire contents of which are incorporated herein by reference.

FIELD OF THE INVENTION

The present invention relates to a steering device, a steering device for a ship and a switching valve.

BACKGROUND OF THE INVENTION

In the related art, a cylinder device is available and is used in various fields. As an example, JP-A-H06-127475 discloses a power tilt/power steering device including a power tilt hydraulic cylinder for tilting up and down an outboard motor body of an outboard motor and a power steering hydraulic cylinder for swinging the outboard motor body of the outboard motor.

As for the cylinder device, a configuration is available in which a relief valve such as a thermal valve and a shock valve is used so as to keep a pressure in an oil passage within a predetermined range. By relieving an operating oil to an oil storage tank via the relief valve, it is possible to suppress an excessive increase in pressure in the oil passage due to temperature rise or applying of a shock.

On the other hand, according to the configuration, in order to relieve the operating oil to the oil storage tank, it is necessary to provide the relief valve and the oil passage connected to the oil storage tank having the relief valve arranged thereon, so that a degree of freedom of an oil passage design is lowered.

The present disclosure has been made in view of the above situations, and an object thereof is to implement a steering device having improved a degree of freedom of an oil passage design without necessarily requiring a relief valve.

SUMMARY OF THE INVENTION

According to an aspect of the present disclosure, there is provided a steering device including: a cylinder demarcated into a first chamber and a second chamber by a piston; a main valve having a first shuttle chamber and a second shuttle chamber; a hydraulic source of a forward/reverse rotation type having a first discharge port and a second discharge port; a first oil passage configured to connect the first chamber of the cylinder and the first shuttle chamber; a second oil passage configured to connect the second chamber of the cylinder and the second shuttle chamber; a third oil passage configured to connect the first shuttle chamber of the main valve and the first discharge port; a fourth oil passage configured to connect the second shuttle chamber of the main valve and the second discharge port; and a tank connected to the main valve via the third oil passage and the fourth oil passage, wherein one of the first shuttle chamber and the second shuttle chamber of the main valve is in an opened state when the hydraulic source is stopped.

According to an aspect of the present disclosure, there is also provided a steering device for a ship comprising the steering device.

According to an aspect of the present disclosure, there is also provided a switching valve including: a first piston arranged on a first oil passage; a second piston arranged on a second oil passage; and a spool arranged between the first piston and the second piston, wherein the spool is pushed by a high pressure-side piston arranged on an oil passage on a relatively high pressure-side, which is one of the first piston and the second piston, thereby closing the oil passage on the high pressure-side, and pushes a low pressure-side piston arranged on an oil passage on a relatively low pressure-side, which is the other of the first piston and the second piston, thereby opening the oil passage on the low pressure-side.

DETAILED DESCRIPTION OF THE INVENTION

First Embodiment

Figure 1:
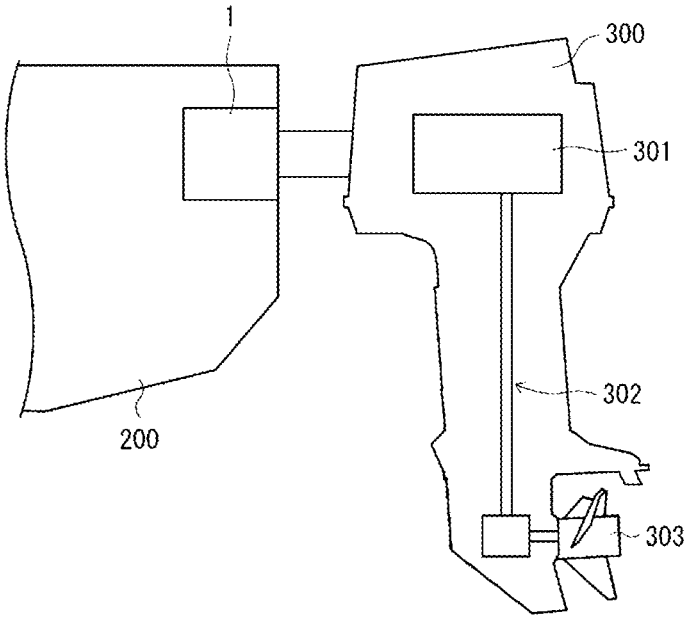
FIG. 1 depicts a use example of a steering device 1 of a first embodiment and a schematic internal configuration of an outboard motor 300.

A steering device 1 of a first embodiment is described with reference to FIGS. 1 to 3.

A steering device of the present embodiment is, as an example, a steering device for a ship 1 (hereinbelow, referred to as "steering device 1") that is used so as to swing an outboard motor right and left. As shown in FIG. 1, the steering device 1 is attached to a rear part of a ship body (body) 200 so as to connect to an outboard motor 300. The outboard motor 300 includes an engine 301, a propeller 303, and a power transmission mechanism 302 configured to transmit power from the engine 301 to the propeller 303.

The steering device 1 can control a traveling direction of the ship body 200 by swinging the outboard motor 300 right and left. More specifically, the outboard motor 300 is attached to connect to a piston 12*c* of a cylinder 12 of the steering device 1, which will be described later. The piston 12*c* is moved right and left, so that the outboard motor 300 swings right and left.

As another example, in a configuration where a rotary shaft of the propeller is fixed to the ship body and a rudder is provided at the rear of the propeller in the traveling direction, the steering device 1 of the present embodiment may also be used.

Subsequently, a hydraulic circuit of the steering device 1 is described with reference to FIG. 2. FIG. 2 depicts the hydraulic circuit of the steering device 1. As shown in FIG. 2, the steering device 1 includes a main valve (switching valve) 11, a cylinder 12, a hydraulic source 13, an orifice 14*a*, an orifice 14*b*, a check valve 15*a*, a check valve 15*b*, a manual valve 16, a relief valve (shock valve) 17, an oil storage tank (tank) 18, a motor 20 and a first oil passage C1 to an eighth oil passage C8.

The hydraulic source 13 that is driven by the motor 20 is a hydraulic source of a forward/reverse rotation type and having a first discharge port 13*a* and a second discharge port 13*b*. The hydraulic source 13 is configured to perform any one operation of "forward rotation", "reverse rotation" and "stop", in response to control by a user. In the oil storage tank 18, an operating oil is stored.

Figure 2:
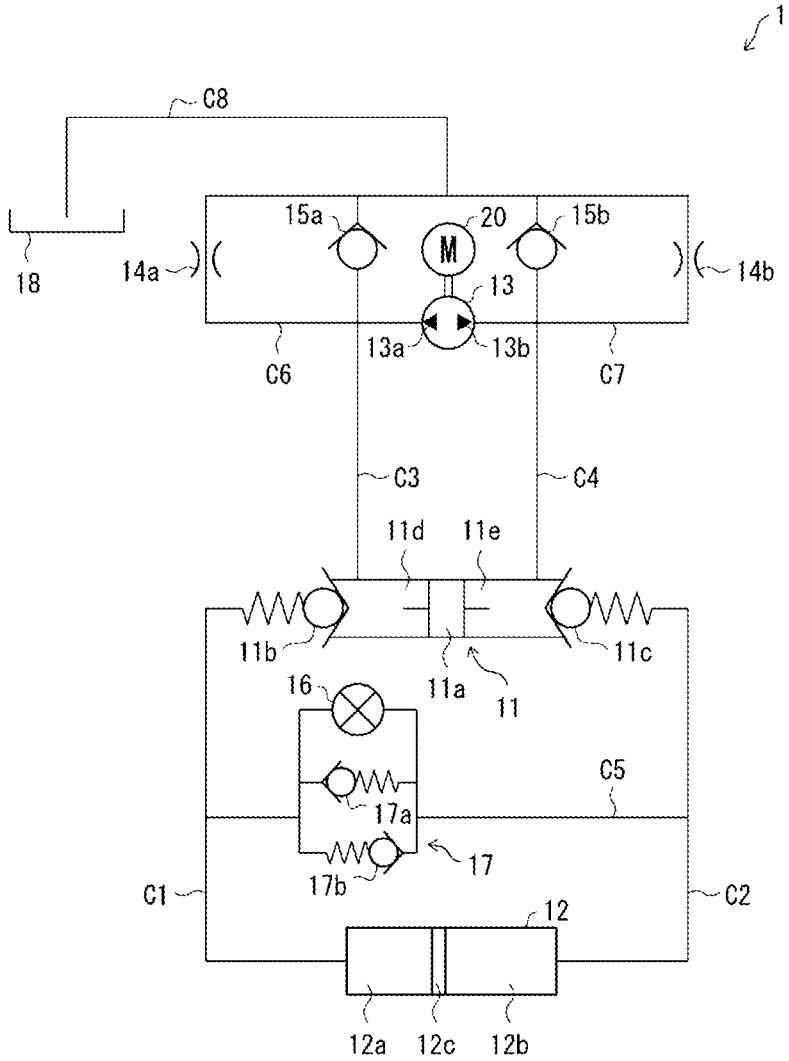
FIG. 2 depicts a hydraulic circuit of the steering device 1 of the first embodiment.
Figure 3:
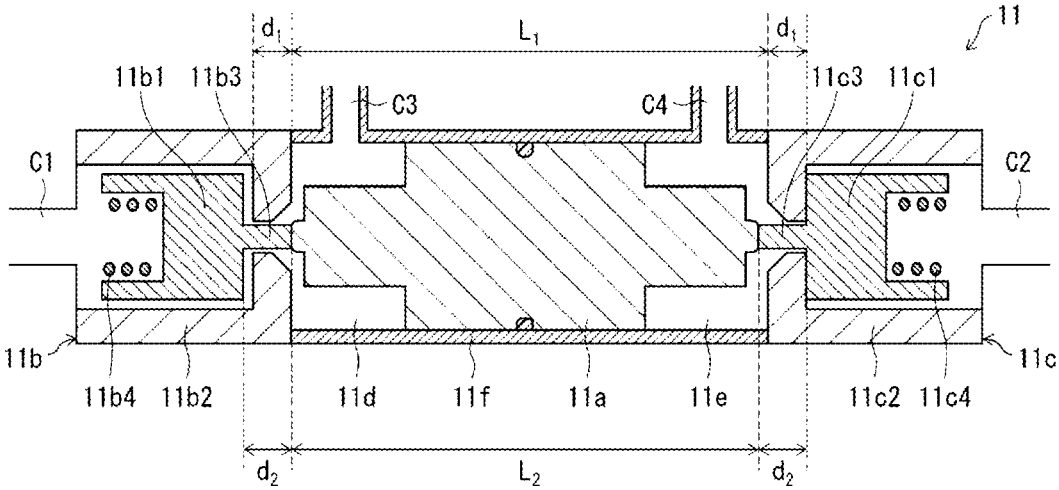
FIG. 3 is an enlarged view depicting an internal configuration of a main valve 11 of the first embodiment.

As pictorially shown in FIG. 2, the main valve 11 has a spool 11*a*, a first check valve 11*b*, a second check valve 11*c*, a first shuttle chamber 11*d*, a second shuttle chamber 11*e* and a housing 11*f* (refer to FIG. 3 as for the housing 11*f*). A specific configuration of the main valve will be described later.

The cylinder 12 is demarcated into a first chamber 12*a* and a second chamber 12*b* by the piston 12*c*.

The first oil passage C1 connects the first chamber 12*a* of the cylinder 12 and the first shuttle chamber 11*d* of the main valve 11 each other. The second oil passage C2 connects the second chamber 12*b* of the cylinder 12 and the second shuttle chamber 11*e* of the main valve 11 each other.

The hydraulic source 13 has the first discharge port 13*a* connected to the first shuttle chamber 11*d* of the main valve 11 via the third oil passage C3, and the second discharge port 13*b* connected to the second shuttle chamber 11*e* of the main valve 11 via the fourth oil passage C4.

The third oil passage C3 connects the first discharge port 13*a* and the first shuttle chamber 11*d* each other, and also connects the first discharge port 13*a* and the check valve 15*a* each other. The fourth oil passage C4 connects the second discharge port 13*b* and the second shuttle chamber 11*e* each other, and also connects the second discharge port 13*b* and the check valve 15*b* each other.

The manual valve 16 and the relief valve 17 are arranged on the fifth oil passage C5 that connects the first oil passage C1 and the second oil passage C2 each other.

The orifice 14*a* is arranged on the sixth oil passage C6 that connects the third oil passage C3 and the eighth oil passage C8 each other. The orifice 14*b* is arranged on the seventh oil passage C7 that connects the fourth oil passage C4 and the eighth oil passage C8 each other.

The eighth oil passage C8 connects the sixth oil passage C6, seventh oil passage C7, check valve 15*a* and check valve 15*b* and the oil storage tank 18.

When the hydraulic source 13 still tries to collect the operating oil even though the piston 12*c* is completely sent toward the first chamber 12*a*, the check valve 15*a* supplies the operating oil from the oil storage tank 18 to the hydraulic source 13.

When the hydraulic source 13 still tries to collect the operating oil even though the piston 12*c* is completely sent toward the second chamber 12*b*, the check valve 15*b* supplies the operating oil from the oil storage tank 18 to the hydraulic source 13.

The manual valve 16 can be manually opened and closed. During maintenance for the steering device 1, for example, the manual valve 16 is opened, so that the operating oil is returned from the first chamber 12*a* to the second chamber 12*b*.

The relief valve 17 has a check valve 17*a* and a check valve 17*b*. The relief valve 17 is configured to restrict flow of the operating oil between the first chamber 12*a* and the second chamber 12*b* of the cylinder 12 via the fifth oil passage C5.

When supplying the operating oil to the hydraulic circuit so that the piston 12*c* slides from the first chamber 12*a* toward the second chamber 12*b*, the check valve 17*a* is opened if the hydraulic pressure to the cylinder 12 rapidly increases. Thereby, the operating oil in the first chamber 12*a* where the hydraulic pressure has increased can be relieved to the second chamber 12*b*, so that a load of the hydraulic pressure to the cylinder 12 is suppressed.

When supplying the operating oil to the hydraulic circuit so that the piston 12*c* slides from the second chamber 12*b* toward the first chamber 12*a*, the check valve 17*b* is opened if the hydraulic pressure to the cylinder 12 rapidly increases. Thereby, the operating oil in the second chamber 12*b* where the hydraulic pressure has increased can be relieved to the first chamber 12*a*, so that a load of the hydraulic pressure to the cylinder 12 is suppressed.

Examples of the rapid increase in hydraulic pressure of the cylinder include a case where the piston is slid so that, when a shock load is applied to the outboard motor, the cylinder absorbs the shock. When the shock load is applied, it is preferably to lock the cylinder for safety. However, in the steering device of the related art, a relief destination of the relief valve is usually the oil storage tank, and the operating oil is relieved from a cylinder chamber on a side, on which the hydraulic pressure has increased due to sliding of the piston, toward the tank. Thereby, in the steering device of the related art, in a cylinder chamber on an opposite side to the cylinder chamber on the side on which the hydraulic pressure has increased, a vacuum space is generated due to a shortage of the operating oil for a sliding amount of the piston. In this way, according to the steering device of the related art, when the shock load is applied, a pressure difference due to the vacuum is generated between the two cylinder chambers, so that the cylinder cannot be locked.

In contrast, according to the steering device 1 of the present embodiment, as described above, when the shock load is applied to the outboard motor 300, the operating oil can be relieved from the cylinder chamber, on a side on which a pressure has increased, of the first chamber 12*a* and the second chamber 12*b* of the cylinder 12 toward the cylinder chamber on an opposite side. In this way, according to the steering device 1 of the present embodiment, even when the piston 12*c* is moved due to the shock load and the like, the operating oil can be favorably moved from the cylinder chamber on the side on which the pressure has increased toward the cylinder chamber on the opposite side. Therefore, even after the shock is absorbed, the cylinder can be locked without generating the vacuum space in the cylinder 12.

(Main Valve 11)

Subsequently, a configuration example of the main valve 11 is described with reference to FIG. 3. As shown in FIG. 3, the main valve 11 has the spool 11*a*, the first check valve 11*b*, the second check valve 11*c*, the first shuttle chamber 11*d*, the second shuttle chamber 11*e* and the housing 11*f*.

The first check valve 11*b* has a first piston 11*b*1 and a housing 11*b*2. The first piston 11*b*1 has a first protrusion 11*b*3 and a first spring 11*b*4. The first piston 11*b*1 is arranged on the first oil passage C1. The second check valve 11*c* has a second piston 11*c*1 and a housing 11*c*2. The second piston 11*d* has a second protrusion 11*c*3 and a second spring 11*c*4. The second piston 11*c*1 is arranged on the second oil passage C2.

The spool 11*a* is arranged between the first piston 11*b*1 and the second piston 11*c*1 so as to slide toward the first check valve 11*b* or the second check valve 11*c*.

The spool 11*a* is arranged so that one end portion of the spool 11*a* is in contact with the first protrusion 11*b*3 of the first piston 11*b*1 by the first spring 11*b*4 pushing the first piston 11*b*1 toward the second check valve 11*c*. The spool 11*a* is also arranged so that the other end portion of the spool 11*a* is in contact with the second protrusion 11*c*3 of the second piston 11c1 by the second spring 11c4 pushing the second piston 11c1 toward the first check valve 11b.

When the hydraulic source 13 is stopped, the shuttle chamber on the low pressure-side of the first shuttle chamber 11d and the second shuttle chamber 11e of the main valve 11 is opened. Specifically, the spool 11a is pushed by the high pressure-side piston arranged on the oil passage on a relatively high pressure-side of the first piston 11b1 and the second piston 11c1, thereby closing the oil passage on the high pressure-side, and pushes the low pressure-side piston arranged on the oil passage on a relatively low pressure-side, thereby opening the oil passage on the low pressure-side.

(Operation Example of Main Valve 11)

In the below, an operation example of the main valve when the hydraulic source 13 is stopped is more specifically described.

(When Hydraulic Pressure in First Oil Passage C1 is High)

When the hydraulic source 13 is stopped, if the hydraulic pressure in the first oil passage C1 is relatively higher than the hydraulic pressure in the second oil passage C2, the first piston 11b1 is slid toward the second check valve 11c. The first piston 11b1 is slid toward the second check valve 11c to shut off the first check valve 11b, and the first piston 11b1 pushes the spool 11a via the first protrusion 11b3. The spool 11a is pushed by the first piston 11b1 and is thus slid toward the second check valve 11c. The spool 11a is slid toward the second check valve 11c to push the second piston 11c1 via the second protrusion 11c3, thereby opening the second check valve 11c.

(When Hydraulic Pressure in Second Oil Passage C2 is High)

When the hydraulic source 13 is stopped, if the hydraulic pressure in the second oil passage C2 is relatively higher than the hydraulic pressure in the first oil passage C1, the second piston 11c1 is slid toward the first check valve 11b. The second piston 11c1 is slid toward the first check valve 11b to shut off the second check valve 11c, and the second piston 11c1 pushes the spool 11a via the second protrusion 11c3. The spool 11a is pushed by the second piston 11c1 and is thus slid toward the first check valve 11b. The spool 11a is slid toward the first check valve 11b to push the first piston 11b1 via the first protrusion 11b3, thereby opening the first check valve 11b.

In this way, when the hydraulic source 13 is stopped, the main valve 11 of the present embodiment shuts off the oil passage on the high pressure-side, and opens the oil passage on the low pressure-side. Thereby, when the temperature of the steering device 1 rises, the operating oil expanded in the oil passage due to the temperature rise can be relieved to the tank 18 via the opened check valve of the main valve 11. For this reason, in the hydraulic circuit on the further cylinder-side than the main valve 11, it is not necessary to provide a thermal valve and an oil passage connected to the tank 18 and having the thermal valve arranged thereon, so that it is possible to improve a degree of freedom of the oil passage design.

Second Embodiment

A steering device of a second embodiment is described with reference to FIG. 4.

Figure 4:
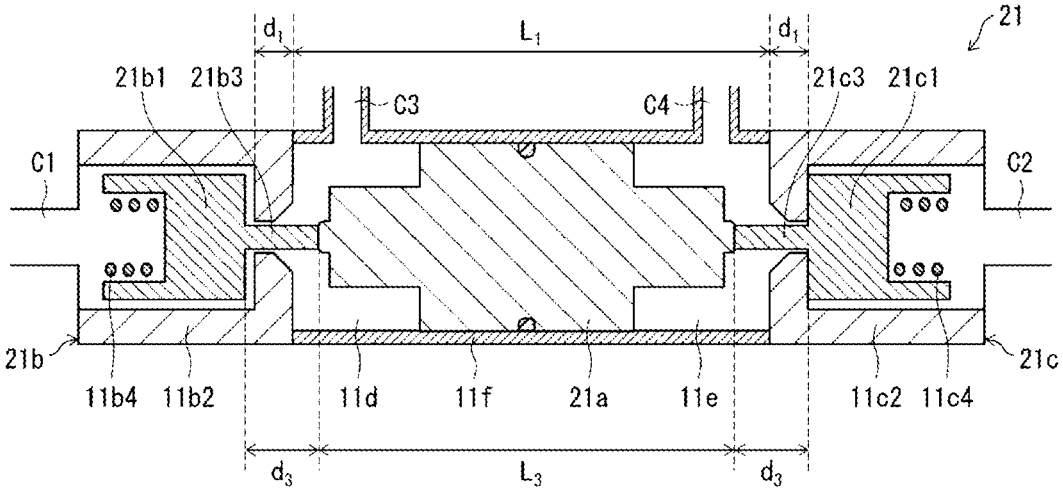
FIG. 4 is an enlarged view depicting an internal configuration of a main valve 21 of a second embodiment.

FIG. 4 depicts a configuration example of a main valve 21 provided to a steering device of the second embodiment. In the main valve 21 of the present embodiment, a spool 21a, a first check valve 21b and a second check valve 21c are provided, instead of the spool 11a, the first check valve 11b and the second check valve 11c in the main valve 11 of the first embodiment. Note that, in descriptions below, the similar members to the members already described are denoted with the same reference signs, and the descriptions thereof are omitted.

As shown in FIG. 4, the first check valve 21b has a first piston 21b1 and a housing 11b2. The first piston 21b1 has a first protrusion 21b3 and a first spring 11b4. The first piston 21b1 is arranged on the first oil passage C1 so that the first protrusion 21b3 protrudes into the first shuttle chamber 11d of the main valve 21 when the hydraulic source 13 is stopped. The second check valve 21c has a second piston 21c1 and a housing 11c2. The second piston 21c1 has a second protrusion 21c3 and a second spring 11c4. The second piston 21c1 is arranged on the second oil passage C2 so that the second protrusion 21c3 protrudes into the second shuttle chamber 11e of the main valve 21 when the hydraulic source 13 is stopped.

Lengths $d_3$ of the first protrusion 21b3 and the second protrusion 21c3 are formed larger than lengths $d_2$ of the first protrusion 11b3 and the second protrusion 21c3 of the first embodiment.

A summed value $L_3+2d_3$ of lengths of the spool 21a, the first protrusion 21b3 and the second protrusion 21c3 is the same as a summed value $L_2+2d_2$ of lengths of the spool 11a, the first protrusion 21b3 and the second protrusion 21c3 of the first embodiment. For this reason, the length $L_3$ of the spool 21a can be configured to be shorter by the increased lengths $d_3$ of the first protrusion 21b3 and the second protrusion 21c3.

Similarly to the main valve 11 of the first embodiment, the main valve 21 of the present embodiment can shut off the oil passage on the high pressure-side and open the oil passage on the low pressure-side when the hydraulic source 13 is stopped. Thereby, when the temperature of the steering device 1 rises, the operating oil expanded in the oil passage due to the temperature rise can be relieved to the tank 18 via the opened check valve of the main valve 21. For this reason, in the hydraulic circuit on the further cylinder-side than the main valve 21, it is not necessary to provide a thermal valve and an oil passage connected to the tank 18 and having the thermal valve arranged thereon, so that it is possible to improve a degree of freedom of the oil passage design.

Third Embodiment

Figure 5:
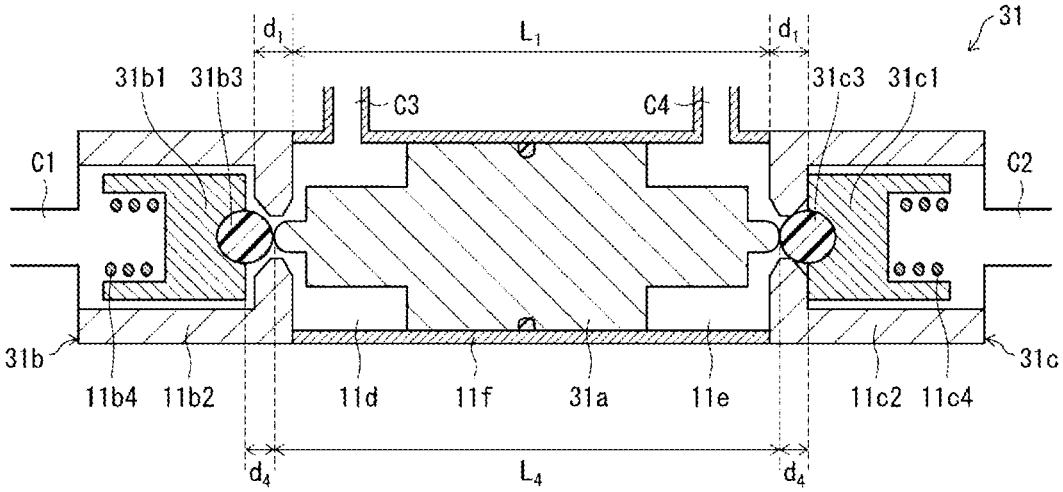
FIG. 5 is an enlarged view depicting an internal configuration of a main valve 31 of a third embodiment.

A steering device of a third embodiment is described with reference to FIG. 5. FIG. 5 depicts a configuration example of a main valve 31 provided to a steering device of the third embodiment. In the main valve 31 of the present embodiment, a spool 31a, a first check valve 31b and a second check valve 31c are provided, instead of the spool 11a, the first check valve 11b and the second check valve 11c in the main valve 11 of the first embodiment. Note that, in descriptions below, the similar members to the members already described are denoted with the same reference signs, and the descriptions thereof are omitted.

As shown in FIG. 5, the first check valve 31b has a first piston 31b1 and a housing 11b2. The first piston 31b1 has a first ball 31b3 and a first spring 11b4. The second check valve 31c has a second piston 31c1 and a housing 11c2. The second piston 31c1 has a second ball 31c3 and a second spring 11c4.

The spool 31a is arranged so that one end portion of the spool 31a is in contact with the first ball 31b3 of the first piston 31b1 by the first spring 11b4 pushing the first piston 31b1 toward the second check valve 31c. The spool 31a is also arranged so that the other end portion of the spool 31*a* is in contact with the second ball 31*c*3 of the second piston 31*c*1 by the second spring 11*c*4 pushing the second piston 31*c*1 toward the first check valve 31*b*.

A summed value $L_4+2d_4$ of lengths of the spool 31*a*, the first ball 31*b*3 protruding from the first piston 31*b*1 and the second ball 31*c*3 protruding from the second piston 31*c*1 is the same as the summed value $L_2+2d_2$ of lengths of the spool 11*a*, the first protrusion 21*b*3 and the second protrusion 21*c*3 of the first embodiment.

Similarly to the main valve 11 of the first embodiment, the main valve 31 of the present embodiment can shut off the oil passage on the high pressure-side and open the oil passage on the low pressure-side when the hydraulic source 13 is stopped. Thereby, when the temperature of the steering device 1 rises, the operating oil expanded in the oil passage due to the temperature rise can be relieved to the tank 18 via the opened check valve of the main valve 31. For this reason, in the hydraulic circuit on the further cylinder-side than the main valve 31, it is not necessary to provide a thermal valve and an oil passage connected to the tank 18 and having the thermal valve arranged thereon, so that it is possible to improve a degree of freedom of the oil passage design.

In addition, the first piston 31*b*1 and the second piston 31*c*1 are configured to have the ball structure, instead of the protrusion, so that they can be applied to higher hydraulic pressure environments.

According to the present disclosure, it is possible to implement the steering device having improved the degree of freedom of the oil passage design.

The present invention is not limited to each embodiment, and can be variously changed within the scope defined in the claims. The embodiments obtained by appropriately combining the technical means disclosed in the different embodiments are also included within the technical scope of the present invention.

What is claimed is:

1. A steering device comprising:

a cylinder demarcated into a first chamber and a second chamber by a piston;

a main valve having a first shuttle chamber and a second shuttle chamber;

a hydraulic source of a forward/reverse rotation type having a first discharge port and a second discharge port;

a first oil passage configured to connect the first chamber of the cylinder and the first shuttle chamber;

a second oil passage configured to connect the second chamber of the cylinder and the second shuttle chamber;

a third oil passage configured to connect the first shuttle chamber of the main valve and the first discharge port;

a fourth oil passage configured to connect the second shuttle chamber of the main valve and the second discharge port; and a tank connected to the main valve via the third oil passage and the fourth oil passage, wherein one of the first shuttle chamber and the second shuttle chamber of the main valve is in an opened state when the hydraulic source is stopped, the main valve has:

a first piston arranged on the first oil passage;

a second piston arranged on the second oil passage; and a spool arranged between the first piston and the second piston, and the spool is pushed by a high pressure-side piston arranged on an oil passage on a high pressure-side, which is one of the first piston and the second piston, thereby closing the oil passage on the high pressure-side, and pushes a low pressure-side piston arranged on an oil passage on a low pressure-side, which is the other of the first piston and the second piston, thereby opening the oil passage on the low pressure-side.

2. The steering device according to claim 1, wherein the first piston has a first protrusion and a first spring, the second piston has a second protrusion and a second spring, and the spool is arranged so that one end portion of the spool is in contact with the first protrusion of the first piston by the first spring pushing the first piston and the other end portion of the spool is in contact with the second protrusion of the second piston by the second spring pushing the second piston.

3. The steering device according to claim 2, wherein the first piston is arranged so that the first protrusion protrudes into the first shuttle chamber of the main valve and the second piston is arranged so that the second protrusion protrudes into the second shuttle chamber of the main valve, when the hydraulic source is stopped.

4. The steering device according to claim 1, wherein the first piston has a first ball and a first spring, the second piston has a second ball and a second spring, and the spool is arranged so that one end portion of the spool is in contact with the first ball of the first piston by the first spring pushing the first piston and the other end portion of the spool is in contact with the second ball of the second diaphragm by the second spring pushing the second piston.

5. A steering device comprising:

a cylinder demarcated into a first chamber and a second chamber by a piston;

a main valve having a first shuttle chamber and a second shuttle chamber;

a hydraulic source of a forward/reverse rotation type having a first discharge port and a second discharge port;

a first oil passage configured to connect the first chamber of the cylinder and the first shuttle chamber;

a second oil passage configured to connect the second chamber of the cylinder and the second shuttle chamber;

a third oil passage configured to connect the first shuttle chamber of the main valve and the first discharge port;

a fourth oil passage configured to connect the second shuttle chamber of the main valve and the second discharge port;

a tank connected to the main valve via the third oil passage and the fourth oil passage; and a fifth oil passage configured to connect the first oil passage and the second oil passage, wherein one of the first shuttle chamber and the second shuttle chamber of the main valve is in an opened state when the hydraulic source is stopped, and the fifth oil passage has a relief valve configured to restrict flow of an operating oil between the first chamber of the cylinder and the second chamber of the cylinder.

6. The steering device according to claim 1, further comprising a fifth oil passage configured to connect the first oil passage and the second oil passage, wherein the fifth oil passage has a relief valve configured to restrict flow of an operating oil between the first chamber of the cylinder and the second chamber of the cylinder.

7. A steering device for a ship comprising the steering device according to claim 1.

8. The steering device according to claim 2, further comprising a fifth oil passage configured to connect the first oil passage and the second oil passage, wherein the fifth oil passage has a relief valve configured to restrict flow of an operating oil between the first chamber of the cylinder and the second chamber of the cylinder.

9. A steering device for a ship comprising the steering device according to claim 2.

10. The steering device according to claim 3, further comprising a fifth oil passage configured to connect the first oil passage and the second oil passage, wherein the fifth oil passage has a relief valve configured to restrict flow of an operating oil between the first chamber of the cylinder and the second chamber of the cylinder.

11. A steering device for a ship comprising the steering device according to claim 3.

12. The steering device according to claim 4, further comprising a fifth oil passage configured to connect the first oil passage and the second oil passage, wherein the fifth oil passage has a relief valve configured to restrict flow of an operating oil between the first chamber of the cylinder and the second chamber of the cylinder.

13. A steering device for a ship comprising the steering device according to claim 4.

14. A steering device for a ship comprising the steering device according to claim 5.

15. A switching valve comprising:

a first piston arranged on a first oil passage;

a second piston arranged on a second oil passage; and a spool arranged between the first piston and the second piston, wherein the spool is pushed by a high pressure-side piston arranged on an oil passage on a high pressure-side, which is one of the first piston and the second piston, thereby closing the oil passage on the high pressure-side, and pushes a low pressure-side piston arranged on an oil passage on a low pressure-side, which is the other of the first piston and the second piston, thereby opening the oil passage on the low pressure-side.

* * * * *